US005105637A

United States Patent [19]

Kovens

[11] Patent Number: 5,105,637

[45] Date of Patent: Apr. 21, 1992

[54] CONVERTIBLE BARREL LOCK

[75] Inventor: Murray R. Kovens, Whitehall, Md.

[73] Assignee: Parkway Machine Corporation, Timonium, Md.

[21] Appl. No.: 593,803

[22] Filed: Oct. 5, 1990

[51] Int. Cl.[5] ..... E05B 27/08

[52] U.S. Cl. ..... 70/491; 29/401.1; 29/434; 70/367; 70/382

[58] Field of Search ..... 70/382, 384, 385, 491, 70/420, 383, 367-369, 496, 461, 374, 356, DIG. 37, DIG. 44, DIG. 71; 29/401.1, 434

[56] References Cited

U.S. PATENT DOCUMENTS

| | | | |
|---|---|---|---|
| 3,251,205 | 5/1966 | Kerr . | |
| 3,258,945 | 7/1966 | Kerr . | |
| 3,261,188 | 7/1966 | Kerr . | |
| 3,422,646 | 1/1969 | Monahan | 70/491 |
| 3,681,955 | 8/1972 | Sturgeon | 70/491 |
| 3,903,720 | 9/1975 | Scherbing | 70/382 X |
| 3,916,657 | 11/1975 | Steinbach | 70/338 |
| 4,041,739 | 8/1977 | Mercuiro | 70/491 |
| 4,712,400 | 12/1987 | Steinbach | 70/369 |
| 4,858,456 | 8/1989 | McGee, Sr. | 70/383 X |

*Primary Examiner*—Lloyd A. Gall
*Attorney, Agent, or Firm*—Leydig, Voit & Mayer

[57] ABSTRACT

A barrel lock includes a circumferential axial pin tumbler arrangement housed in the barrel. A removable pilot post is disposed among the tumblers and has key-guides which register with mating key-guides on an actuating key. To change the lock combination, the lock can be reassembled with the pilot post located in a new rotational orientation relative to the tumbler arrangement. A particular application includes locking merchandise compartments in vending machines, for example.

4 Claims, 2 Drawing Sheets

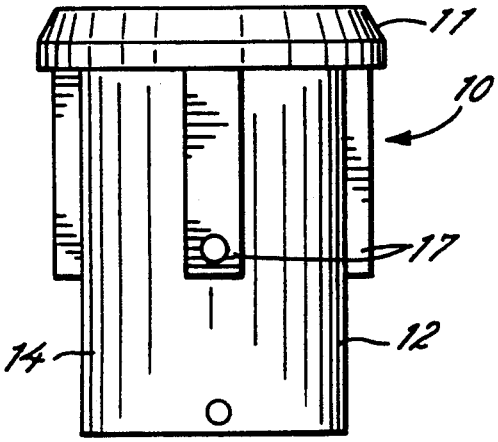
FIG. 1
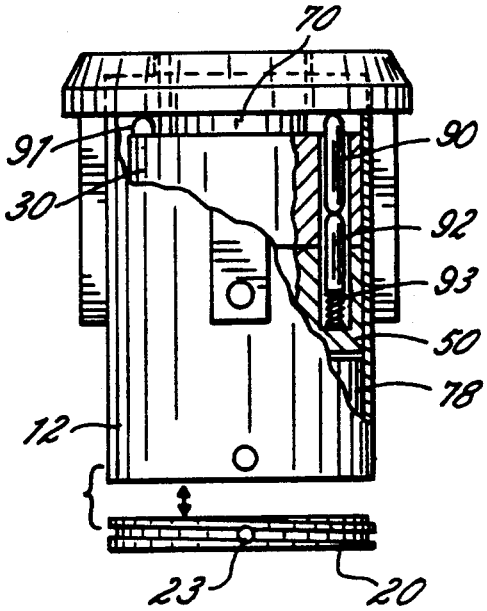
FIG. 2
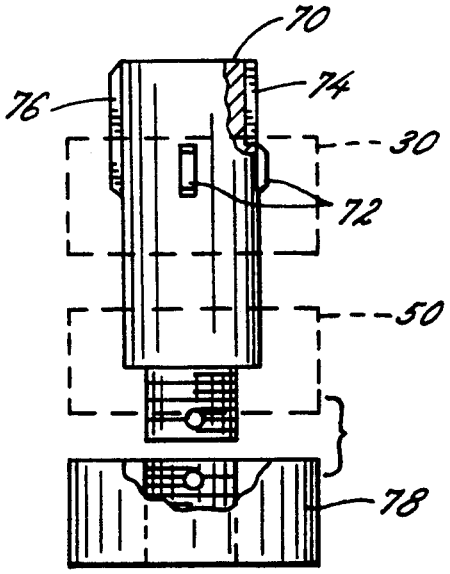
FIG. 4
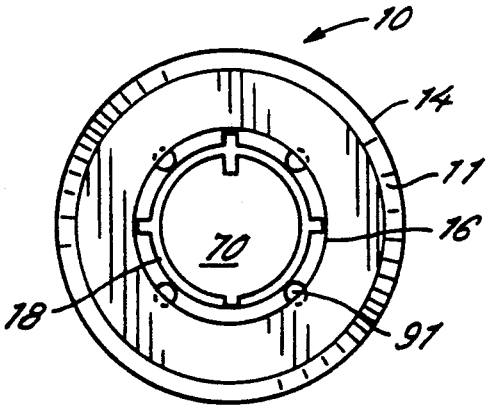
FIG. 3
FIG. 5
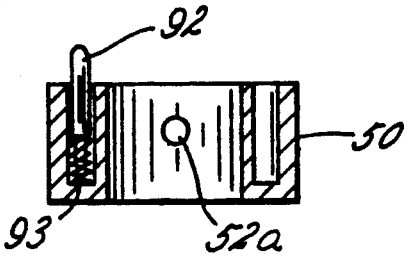

CONVERTIBLE BARREL LOCK

TECHNICAL FIELD

The present invention pertains to the field of locks. More particularly, the invention concerns a barrel lock assembly with axial pin tumblers and method for changing the combination. Further, the invention conceives such a lock which may be reconfigured converting the assembly to a different lock combination.

BACKGROUND OF THE INVENTION

The present invention concerns locks of the axial pin tumbler type. This form of lock is well known in the art as exemplified by U.S. Pat. Nos. 3,261,188 and 3,258,945. A barrel lock derives its name from the fact that it includes a barrel-like structure disposed within a housing. Typically, the barrel is employed in vending machines and coin operated vending machines. The actuating element often consists of a pivoted lever or latch which toggles between unlocked and locked positions when rotated through a short arc. In the case of coin operated bulk vending machines, the actuating element is a threaded connection between the barrel lock, itself, and a threaded rod.

Referring to U.S. Pat. No. 3,258,945, it describes a conventional barrel lock where the combination, defined by axial pins, can be changed. The patent describes a removable pilot shaft, the position of which is fixed relative to the housing due to the cooperation of a positioning lug in the housing wall and a mating groove on the pilot shaft. With respect to changing the barrel lock combination, it exemplifies the prior art, i.e. the requirement to completely disassemble the tumblers once the pilot shaft is removed to reset the combination.

Often for security reasons, there is a need to change the lock combination of a barrel lock, and in some instances, changing the combination on a regular basis is a matter of management policy. A barrel lock combination is changed by disassembling the lock and replacing the tumblers. The new installed tumbler arrangement has different tumbler pin pairs (split pins) of different lengths and the new split pin tumbler combination provides an assembly having a different pin depth configuration. Accordingly, a new key corresponding to the new depth configuration is required.

Tumbler conversion of conventional barrel locks have the following principal disadvantages. The conversion of the lock combination is complicated, time consuming and troublesome in that a large number of delicate parts must be disassembled, removed and reassembled. Typically, there are many split pin tumblers (four to seven) where each tumbler comprises two pins and a small spring. These pins and springs are small and difficult to manipulate. Consequently, care and accuracy must be exercised to install the tumbler components in their proper plan location according to the new combination to correspond with the new key. In other words, to change the combination, accurate matching of each pin of the upper pin set with its mating pin of the lower set and placement in the barrel lock is required.

Clearly, the great number of small parts greatly increases the likelihood of mishandling and loss. Furthermore, in most assemblies, a number of other parts must also be removed even before achieving access to the tumbler assembly. Thus, yet more parts must be removed, accounted for and replaced.

Another disadvantage related to changing the combination is the need for careful stockpiling of parts (new tumbler sets and corresponding keys). This is inconvenient and increases cost in that the new pins must be ordered, purchased and inventoried. Consequently, not only are part costs increased but also labor costs.

In terms of a functional disadvantage, only the depthwise configuration of the tumbler assembly can be modified in conventional barrel locks. The planar configuration remains the same.

SUMMARY OF THE INVENTION

It is an object of the present invention to overcome the above-mentioned problems of the prior art and provide an improved barrel lock.

It is another object to furnish a barrel lock assembly which provides a plurality of barrel lock combinations from a single assembly using identical parts.

It is another object to provide a tumbler barrel lock maximizing cost savings and labor efficiency while minimizing parts loss and parts requirements.

It is another object of the present invention to provide a barrel lock which can be modified to realize a new lock combination corresponding to a new key without the need for additional lock components.

According to another object of the invention, a barrel lock is provided which is convertible to a new lock combination through a simple disassembly, retaining the tumbler assembly, and by repositioning only a pilot post.

It is another object to provide a barrel lock in which the planar configuration of the lock combination can be changed.

These and other objects are satisfied by an axial pin tumbler lock comprising:

- a tumbler arrangement having a predetermined orientation;
- a removable pilot post; and
- pilot post adjustment means for enabling assembly of the lock with the pilot post in one of a plurality of possible orientations relative to the tumbler arrangement.

Further objects of the present invention are satisfied by a method for changing a barrel lock combination where the barrel lock features a lock casing, a barrel dimensioned to fit within the casing and having a bore passing therethrough, a plurality of prearranged tumblers housed in the barrel, a removable pilot post extending through the barrel bore, a lock plug for securing the pilot post in the barrel and lock casing, and means for rotationally fixing the pilot post to the barrel in any one of a plurality of predetermined orientations relative to the orientation of the tumbler arrangement, the method comprising the steps of:

a) removing the lock plug from the lock casing,
b) sliding the pilot post through the upper and lower lock barrels,
c) rotating the pilot post relative to the lock barrels,
d) inserting the pilot post into the lock barrels, and
e) securing the lock plug on the lock casing.

For the purpose of the description herein, the following terms are defined:

"Barrel lock" includes a housing, a pilot post, a fixed barrel, and a rotatable barrel disposed end-to-end with the fixed barrel. The bottom barrel rotates relative to the pilot post and top barrel but is fixed to the lock housing. The top barrel is fixed relative to the pilot post but rotates with the pilot post relative to the lock housing. In other words, the definition of "fixed" and "rotatable" derives from the fact that the rotatable barrel, while fixed to the housing, rotates relative to the pilot post while the fixed barrel is rotationally fixed to the pilot post. The respective axial facing barrel ends are referred to as the inside ends while the other ends are denominated outside ends.

"Split pin" tumblers refers to two sets of pins, an upper set and a lower set where each individual tumbler consists of two pins which abut at their inside axial ends when aligned. Each set of tumblers is housed in a corresponding one of the two barrels.

"Socket" refers to the annularly disposed, elongated, axial apertures in the barrels which receive and retain a tumbler. Each tumbler pin is housed in a corresponding socket formed in one of the barrels. In the fixed barrel, each socket extends through the barrel thereby defining two open ends. In the rotatable lower barrel, each socket has one blind end disposed near the outside end of the barrel, and one end opening toward the inside end of the barrel.

"Lock combination" defines the geometry of a key which will actuate the lock. The two basic elements defining the lock combination are the plan configuration and the depth configuration of the tumbler assembly.

"Plan configuration" refers to the number and the planar arrangement or position pattern of the split pin tumblers. This arrangement is assumed in a plane normal to the longitudinal axis of the barrels.

"Depth configuration" refers to the arrangement of different axial lengths of the pins. The predetermined axial position pattern comprising the depth configuration is established because each pin has an axial length predetermined in correspondence to its planar position. Hence, when viewed from the exterior of the lock, the outside ends of the upper pins lay in the same axial plane (a level appearance). This conceals the depth configuration to prevent the lock from being "picked" or actuated improperly by unauthorized personnel.

"Key" indicates a tubular, coded key for a barrel lock which possesses a plurality of tumbler actuating features. These features correspond to and complement the lock combination (tumbler number, planar arrangement, and depth configuration of the tumbler arrangement). The key also includes an alignment keeper, an internal groove and internal lug which dimensionally correspond to a lug and groove in the lock barrel. This alignment feature restricts the key insertion to only one position relative to the barrel lock. Consequently, when the appropriate key is inserted, it engages the upper tumbler pins, depresses the pins such that their inside ends are positioned precisely between the fixed and rotatable barrels, and releases the previously interlocked barrels. Thus, the rotatable barrel is free to rotate.

In essence, the invention, in the four position embodiment described below, permits establishment of four different combinations (requiring four different keys), employing the exact same lock parts and requiring only rotation of the pilot post barrel relative to the lower barrel and, hence, the lock casing. There is no need to remove or change the tumblers.

Given the following enabling description of the drawings, the inventive barrel lock as well as the scope of the invention will become evident to a person of ordinary skill in the art.

BRIEF DESCRIPTION OF THE DRAWINGS

FIG. 1 is a side view of a barrel lock according to the present invention.

FIG. 2 is a partial cutaway disassembled side view of the barrel lock.

FIG. 3 is a top view of the barrel lock.

FIG. 4 is a side view of the pilot post with ghost representations of the barrels and a partial cutaway of the tapped cylinder.

FIG. 5 is a cross-sectional view of the lower rotatable barrel.

DETAILED DESCRIPTION OF THE PREFERRED EMBODIMENT

Figure 6:
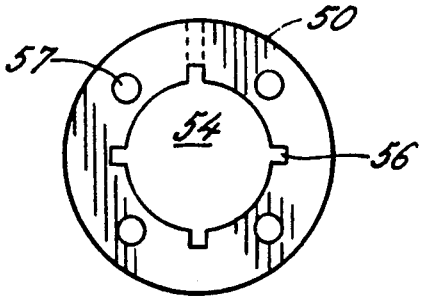
FIG. 6 is a top view of the lower rotatable barrel.
Figure 7:
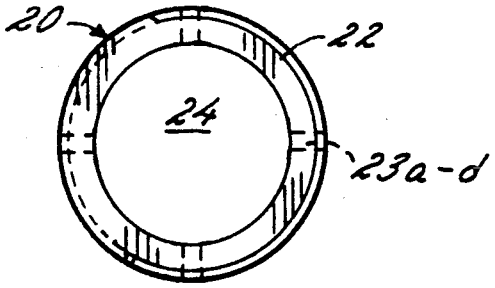
FIG. 7 is a top view of the lock plug.

Referring to FIGS. 1-3, the barrel lock 10 includes a barrel lock casing 12 including a top flange 11, housing a top barrel 30, a bottom barrel 50, a pilot post 70, and a lock plug 20.

The pilot post 70 is ultimately connected to rotate an actuating element. In this case, representing a coin operated bulk vending machine, the actuating element is a tapped threaded cylinder 78 abutting the outer rotatable barrel surface (see FIG. 4). The threaded cylinder 78 is of a diameter corresponding to the inner diameter of casing 12 and is attached to the pilot post 70 with a rivet or screw. Since the aperture in plug 20 has a smaller diameter than the outer diameter of cylinder 78, cylinder 78 abuts rim 22 of plug 20. Plug 20 is screwed onto a threaded rod secured to the machine base to lock the unit (not depicted). The pilot post 70 is rotationally fixed to top barrel 30. Pilot post 70 and top barrel 30 may rotate freely within the casing 12. The bottom barrel 50 is rotationally fixed to the casing 12.

While the casing 12 can be variously configured, in the preferred embodiment, the casing 12 has generally cylindrical outside and inside walls 14, 16, respectively. The inside wall 16 defines a bore 18 of sufficient diameter to accept the two barrels 30, 50 and cylinder 78. The plug 20 is secured to the bottom of the casing 12 to retain the assembly of the cylinder 78, the two barrels 30, 50, and the pilot post 70 within the bore 18.

The plug 20 is secured by screws mating with holes **23*a*-23*d* tapped into the plug. The plug 20 provides a rim 22 abutting the bottom surface of the cylinder 78 in assembly. The rim 22 defines a bore 24 passing through the plug 20. The bore 24 permits passage therethrough of the threaded rod (not depicted) to the cylinder 78**.

The bottom barrel 50 is rotationally fixed to the casing 12 with a set screw which passes through hole 17 (it may be desired to use multiple set screws) tapped through the casing 12 and mates with indent or hole 52 a tapped in the barrel 50 (see FIG. 5). Thus, the set screw is accessible from the exterior of the barrel lock casing 12.

Figure 8:
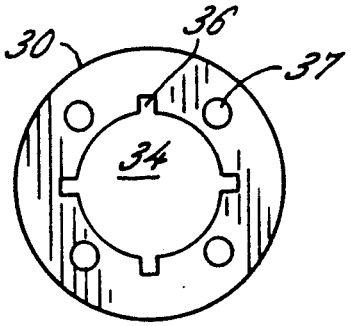
FIG. 8 is a top view of the upper fixed barrel.

Referring to FIGS. 4, 6, and 8, the pilot post 70 is received within central bores 54 and 34 defined in the bottom and top barrels 50 and 30, respectively. The pilot post 70 has four, equicircumferentially spaced lugs 72 and key guide 76. Correspondingly, the barrel bores 54 and 34 define four grooves 56 and 36, respectively, dimensionally matching the lugs 72, 76. (This arrangement is easily reversed, i.e. the pilot post possesses grooves and the barrel bores, lugs.)

To assemble the lock 10, the pilot post 70 is translated axially within the bore 54 of the bottom rotatable barrel with the lugs 72 and lug guide 76 aligned to pass through and beyond the grooves 56. Translation of the pilot post 70 continues into the top (fixed) barrel bore 34. The axial position of pilot post 70 is established with the lugs 72 and key guide 76 received within and engaging the top fixed barrel grooves 36.

The lugs 72, 76 and grooves 36 transmit torque from the pilot post 70 to the top fixed barrel 30, which rotationally fix the pilot post 70 and barrel 30 together. The pilot post 70 is journaled free to rotate within the bore 54 relative to the bottom rotatable barrel 50. This construction allows the pilot post 70 to be removed from the assembly by axially sliding the pilot post out of the barrel bores 34, 54. Once removed, the pilot post 70 can be rotated, in the exemplary embodiment, by an angle of 90° relative to the barrels 30, 50, and reinserted into assembly in the new position. Hence, the pilot post is convertible such that it can be removed from the assembly and reassembled in another of the selected plurality of possible positions in relation to the rotatable barrel and, thus, provide the significant aspect of the invention.

Figure 9:
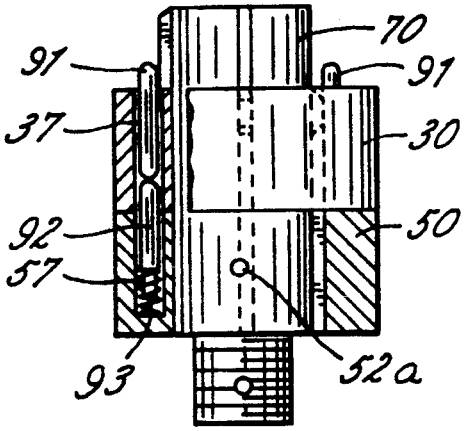
FIG. 9 is a partial cutaway assembly view of the pilot post, upper fixed and lower rotatable barrels and tumblers.

Referring to FIG. 9, a split pin tumbler arrangement 90 is housed within the top (fixed) and bottom (rotatable) barrels 30, 50. The tumbler arrangement includes sets of top and bottom pins 91, 92 respectively. The pins of the top set 91 are nested in cylindrical sockets 37 in the fixed top barrel 30 and the exposed outer-half of the pins abut and are retained by the underside of flange 11 of casing 12 (see FIGS. 2 and 3). In the preferred embodiment, these sockets 37 constitute four bores arranged in a circumferential planar pattern about the wall of the barrel as illustrated. The sockets 37 pass through the barrel and have apertured ends opening to the inside axial ends of fixed top barrel 30 and opening to an outside axial end.

The pins of the bottom set 92 are similarly nested in cylindrical sockets 57 in the rotatable bottom barrel 50. The planar pattern or arrangement of the sockets 57 matches that of sockets 37. Hence, the sockets 37 and 57 align when the fixed barrel 30 assumes a predetermined orientation with respect to the rotatable barrel 50. The bottom sockets 57 have apertured ends at the inside axial end of the barrel 50 which open toward the top barrel 30. However, the sockets 57 have blind ends toward the outside end of the barrel 50.

The tumbler arrangement further includes springs 93. The springs are nested between the blind ends of the bottom sockets 57 and the pins of the bottom set 92. The springs 93 and pins of the fixed set 92 are dimensioned such that the springs urge the pins to protrude beyond the inside socket apertures when the springs are relaxed. When the barrels 30, 50 align, these springs 93 urge the pins of bottom set 92 into the top sockets 37. With the pins 92 crossing the threshold of the top inside socket apertures, the two barrels 30, 50 are interlocked. Because the bottom rotatable barrel 50 is rotationally fixed to the housing, the top barrel 30 and the pilot post 70 rotationally fixed thereto, are also rotationally locked.

In another important aspect of the invention, the pilot post 70 comprises at least one key-guide with which a mating guide on an actuating key is conformed to register. Thus, another function of the pilot post is to define, in part, the geometric form for an actuating key.

Figure 11:
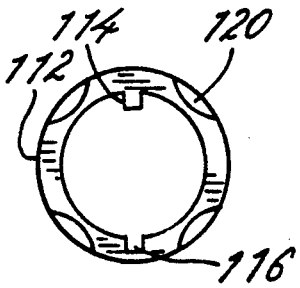
FIG. 11 is a front view of the key tube.
Figure 10:
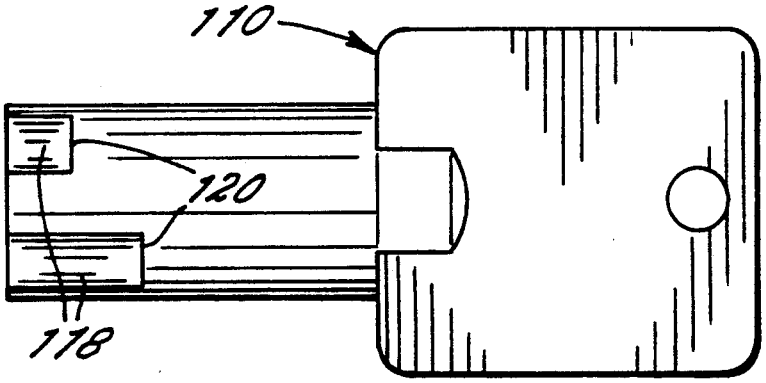
FIG. 10 is a side view of a tubular key for the barrel lock.

In the illustrated embodiment, the pilot post 70 includes two key-guides. These consist of a groove guide 74 and a lug guide 76 (see FIG. 4). As indicated previously, lug guide 76 also acts as a pilot post positioning lug. Correspondingly, FIGS. 10 and 11 depict an actuating key 110 having guides of its own formed to mate with those on the pilot post 70. Thus, the key 110 has a hollow cylinder 112 adapted to accept the pilot post 70 therein. The cylinder 112 has an internal lug guide 114 configured to mate with the pilot post groove guide 74. The cylinder 112 also has an internal groove guide 116 formed to engage the pilot post lug guide 76.

As noted above, an actuating key is also formed with actuating abutments configured to register with and actuate the pins of the tumbler arrangement. Accordingly, as depicted in FIGS. 10 and 11, the key 110 further has kerfs 118 ending in lands 120 which serve as the abutments. The kerfs 118 are arranged in number and planar position corresponding to the plan configuration of the tumbler assembly 90. Similarly, the axial depth pattern of the lands 120 corresponds to the depth configuration of the tumbler assembly 90.

To unlock the barrel lock 10, the key 110 is engaged with the pilot post 70. Pressing down on the tumbler assembly 90 actuates the pins against the springs 93 releasing the fixed barrel 30 from rotatable barrel 50. The key-guides on the pilot post 70 and the key 110 mate to transmit torque from the key to the pilot post, and thus the pilot post and fixed barrel 30 can rotate independently of barrel 50 which is fixed to the housing. Finally, since cylinder 78 is rotationally fixed to pilot post 70, it rotates with pilot post 70 and screws or unscrews onto the rod.

In a lock according to the present invention, the lock combination is defined as agreement between the following two pairs of factors. The first factor comprises agreement between the tumbler configuration of the lock and the kerf configuration of the actuating key. Further, this actually comprises agreement in both planar formation and the depth configuration.

The second factor comprises agreement between the key-guide configurations on the pilot post of the lock and that on the key. Similarly, this agreement also has depth and planar characteristics associated therewith. The planar attribute comprises the number and planar location of the guides. The depth attribute relates to the predetermined axial extent of the guides, for example, agreement in the axial dimension of the key groove guide 116 and that of the matching pilot post lug guide 76.

Also very importantly, the pilot post key-guide provides a geometric reference relative to which an orientation of the pilot post may be assumed. As previously noted, the pilot post may be removed from assembly and reinstalled in a different orientation while maintaining the original tumbler arrangement. The tumbler arrangement in the present invention represents all of the tumbler pins housed within the lock. The tumbler arrangement is regarded as being fixed with respect to the lock in that none of the tumblers need to be moved in the lock as the pilot post is adjusted with respect to the tumbler arrangement. This significant feature allows the lock combination to be changed by merely reinstalling one part, pilot post 70. With the pilot post 70 disposed in a different rotational position, the relationship between the pilot post guides and the tumbler planar formation is changed. Thus, a new key 110 is required to actuate the lock.

In another advantage of the present invention, is that, if necessary to void all four original combinations and keys, the lock combination can be converted in the conventional manner by substituting new pins of the tumbler assembly.

A number of modifications to the described embodiment are considered to be within the purview of the present invention. A description of some specific alternatives contemplated follows.

As noted above, the lug and groove construction between the fixed top barrel and the pilot posts, for example, are considered interchangeable. Thus, the barrel bore may be formed with lugs registering in grooves in the pilot post. Alternatively, the pilot post and fixed barrel may be rotationally secured by means of a set screw or pin similar to that disclosed to rotationally fix the casing and bottom barrel. In this adaptation, an access port would be drilled through the casing wall. The barrel would be rotated to align the set screw positions with the port through which a tool, for example, an allen wrench or screw driver, could gain access to the set screw.

In yet another alternative, the pilot post and the internal bore of the top barrel may have mating non-circular plan forms, for example, elliptical, rectangular or triangular profiles which transmit torque therebetween. Also, the pilot post may have different segments comprising cross-sections of varying profiles or dimensions.

Referring to the barrels, one variation contemplates that the fixed and rotatable barrels be inverted such that the top barrel be rotatably fixed relative to the housing and the bottom barrel be allowed to rotate with the pilot post. However, the preferred embodiment disclosed provides the advantage that, since the rotatable bottom barrel is fixed to the barrel lock casing, the tumbler assembly is held in place within the housing when the pilot post is removed.

Also, the rotatable barrel, being either on the top or bottom, need only be rotatably fixed to the casing. Therefore, any of the alternatives outlined above for rotatably fixing the pilot post and fixed barrel apply here.

The key guides may assume a variety of geometric formations formed on the pilot post. These geometric formations may be in the form of material added, for example, a lug or dowel formed on the pilot post, or may be in the form of material removed, for example, a groove or chamfer on the pilot post. Alternatively, the key guide may comprise the plan form of the pilot post generally. Thus, the key bore and pilot post may have mating non-circular plan forms configured to transmit rotation therebetween.

In another alternative construction, the pilot post may comprise a female member while the mating key has a corresponding male member formed thereon.

Given the foregoing, modifications and variations of the invention should now be evident to the person of ordinary skill in the art. Such modifications and variations are intended to fall within the spirit and scope of this invention as defined by the following claims.

I claim:

1. An axial pin tumbler lock comprising:

a tumbler arrangement having a fixed orientation with respect to the lock;

a removable pilot post; and pilot post adjustment means for enabling assembly of the lock with the pilot post in one of a selected plurality of possible orientations relative to the tumbler arrangement to permit a selected plurality of new lock combinations.

2. An axial pin tumbler lock actuatable between a locked and an unlocked condition by a key with a predetermined form, comprising:

a tumbler arrangement including a plurality of tumblers arranged in a fixed orientation with respect to the lock; and key defining means for adjustably defining an actuating key form, the key defining means including the tumbler arrangement and a removable pilot post having an adjustable rotational orientation relative to the orientation of the tumbler arrangement where each orientation requires a new key to unlock the lock.

3. An axial pin tumbler lock having an adjustable lock combination geometry defining the form of a key which can actuate the lock between a locked and an unlocked condition, the lock comprising:

a tumbler arrangement including a plurality of tumblers arranged in a fixed orientation with respect to the lock;

lock combination means for adjustably defining the lock combination geometry, the lock combination means including the tumbler arrangement and a removable pilot post having an adjustable rotational orientation relative to the orientation of the tumbler arrangement.

4. A method for changing a barrel lock combination where the barrel lock features a lock casing, upper and lower lock barrels dimensioned to fit within the casing and having a bore passing therethrough, a plurality of prearranged tumblers seated in the lower barrel in a defined orientation with respect to the lock casing and compressibly spring biased into the upper barrel, a removable pilot post extending through the barrel bores, a lock plug for securing the pilot post in the barrels and lock casing, and means for rotationally fixing the pilot post to the barrels in any one of a plurality of predetermined orientations relative to the defined orientation of the tumbler arrangement, the method comprising the steps of:

a) removing the lock plug from the lock casing, b) sliding the pilot post through the upper and lower lock barrels while maintaining the tumblers in the defined orientation, c) rotating the pilot post relative to the lock barrels, d) inserting the pilot post into the lock barrels, and e) securing the lock plug on the lock casing.

* * * * *